US007588295B2

(12) United States Patent
Goodman

(10) Patent No.: US 7,588,295 B2
(45) Date of Patent: Sep. 15, 2009

(54) LEGGED SUPPORT

(75) Inventor: Lindsey A. Goodman, Golita, CA (US)

(73) Assignee: Homtomi Holdings, Inc., Goleta, CA (US)

( * ) Notice: Subject to any disclaimer, the term of this patent is extended or adjusted under 35 U.S.C. 154(b) by 9 days.

(21) Appl. No.: 11/544,871

(22) Filed: Oct. 9, 2006

(65) Prior Publication Data

US 2008/0083858 A1 Apr. 10, 2008

(51) Int. Cl.
*A47C 7/02* (2006.01)
*A47B 91/00* (2006.01)

(52) U.S. Cl. ..... 297/452.18; 248/188.91

(58) Field of Classification Search ..... 297/461–462, 297/432.1, 452.18, 445.1, 423.41, 175, 440.22; 108/156, 157.1, 157.16, 157.15; 248/188.1, 248/188.7, 188.8, 188.91, 694
See application file for complete search history.

(56) References Cited

U.S. PATENT DOCUMENTS

| | | | | |
|---|---|---|---|---|
| 417,327 | A | 12/1889 | Lindberg | |
| 632,304 | A * | 9/1899 | Alsberg | 108/156 |
| 705,488 | A * | 7/1902 | Uhl | 297/451.1 |
| 858,389 | A | 7/1907 | Hess | |
| 873,265 | A | 12/1907 | Petroskey | |
| 906,577 | A | 12/1908 | Thomson | |
| 942,793 | A * | 12/1909 | Reineke | 297/461 |
| 2,010,306 | A * | 8/1935 | Leech | 248/412 |
| 2,437,304 | A | 3/1948 | Molla | |
| 2,539,919 | A | 1/1951 | Meek, Jr. et al. | |
| 2,708,965 | A * | 5/1955 | King | 297/461 |
| 3,276,818 | A | 10/1966 | Durfee et al. | |
| D341,266 | S | 11/1993 | Caldwell | |
| D448,195 | S | 9/2001 | Caldwell | |
| 6,517,035 | B1 * | 2/2003 | Sellers | 248/146 |
| D478,223 | S | 8/2003 | Luthersson | |
| 6,749,265 | B1 * | 6/2004 | Wang | 297/440.1 |
| 6,877,443 | B2 * | 4/2005 | Rivera et al. | 108/157.15 |
| 2002/0047298 | A1 | 4/2002 | Brauning | |
| 2005/0126452 | A1 * | 6/2005 | Ziakin | 108/156 |

* cited by examiner

*Primary Examiner*—Milton Nelson, Jr.
(74) *Attorney, Agent, or Firm*—Knobbe Martens Olson & Bear LLP

(57) ABSTRACT

A seating assembly can include a tension ring, two or more legs and a frame. The legs are attached to the tension ring using fasteners, welds and/or the like. The frame is configured to contact each leg at one or more locations, at which forces exerted on the frame can be transferred to the legs. Movement of the legs relative to the tension ring can cause tensile forces to be exerted on the tension ring. When legs are spaced equally apart from one another around the tension ring, the tensile forces on the tension ring balance each other.

26 Claims, 10 Drawing Sheets

LEGGED SUPPORT

BACKGROUND OF THE INVENTIONS

1. Field of the Inventions

The present inventions relate to legged supports for furniture and, more particularly, stools, chairs, other seating devices, tables and the like.

2. Description of the Related Art

A variety of stools, chairs, other seating devices and other furniture with legs are well known. In order to prevent the undesirable spreading or other movement of such legs, it is often necessary to structurally reinforce the lower ends of the legs. For example, one or more intermediate or lower support members that brace the legs can be used.

However, such support members can complicate the manufacture, packaging, transport, assembly and overall design of a stool or other furniture with legs. Moreover, it may be aesthetically displeasing to include such support members. Therefore, it is desirable to provide a simple, reliable, effective and secure base for the structural reinforcement of the legs.

SUMMARY OF THE INVENTIONS

One aspect of at least one of the inventions disclosed herein includes a tension ring and two or more legs that are attached to the tension ring. Tensile forces created by the tendency of the legs to move relative to the tension ring are transferred to the tension ring where they are counteracted by opposing tensile forces. Thus, the tension ring can help prevent spreading, rotation or other undesirable movement of the legs.

According to one arrangement of at least one of the inventions disclosed herein, a support assembly comprises a tension ring with an outer surface, two or more legs and a frame positioned above the tension ring and the legs. Each leg comprises an upper end and a lower end, with the lower end configured to contact a lower support surface, such as a floor. The frame contacts each leg in at least one contacting location situated between the upper end and the lower end of the leg. The tension ring is attached to each leg at a location proximate to the upper end of each leg, and the frame is configured to transfer a force to the legs at the contacting locations. Further, movement of the legs relative to the tension ring causes tensile forces to be exerted on the tension ring.

According to another arrangement of at least one of the inventions disclosed herein, support assembly additionally comprises one or more support members that are configured to connect the lower ends of the legs so as to provide further reinforcement of the legs. In another embodiment, the legs are attached to the tension ring at locations that are substantially equally spaced from each other. In other embodiments, four legs are attached to the tension ring. In still other embodiments, the seating assembly further comprises a cushion which is positioned above the frame.

In accordance with a further aspect of at least one of the inventions disclosed herein, the tension ring has a generally square shape. In another embodiment, the tension ring has a generally circular shape. In other embodiments, the legs are attached to the tension ring using one or more fasteners. In yet another embodiment, the legs are attached to the tension ring using one or more welds.

In accordance with a further aspect of at least one of the inventions disclosed herein, the legs have a split design in which at least a portion of the legs have at least two support members. In another embodiment, the legs are curved into a substantially S shape. In another embodiment, the legs are curved into a substantially Z shape. In one embodiment, the frame is secured to the leg at a location proximate to the contacting location. In yet another embodiment, the frame is secured to the leg using one or more fasteners.

In accordance with a further aspect of at least one of the inventions disclosed herein, the lower ends of the legs contact the lower surface proximate to a location directly below the contacting locations. In another embodiment, the tensile forces exerted on the tension ring substantially balance each other.

In accordance with a further aspect of at least one of the inventions disclosed herein, a support assembly comprises a tension ring, at least two legs and a frame positioned above the tension ring and the legs. The legs comprise a first end that is connected to the tension ring, and a second end that is configured to contact a lower surface. The frame contacts each leg in at least one contacting location, which is situated between the first end and the second end of each leg. The frame is configured to transfer a force to the legs at the contacting locations, and a movement of the legs relative to the tension ring causes tensile forces to be exerted on the tension ring. In other embodiments, the tension ring has a generally square shape. In yet another embodiment, the tension ring has a generally circular shape.

In accordance with a further aspect of at least one of the inventions disclosed herein, a method of reinforcing the legs of a furniture item comprises the steps of providing a tension ring, connecting the first ends of the legs to the tension ring and positioning a frame above the tension ring and the legs. The legs include a second end which is located opposite of the first end and which is configured to contact a lower surface. The frame contacts each leg in at least one contacting location, which is situated between the first end and the second end of each leg. The frame is configured to transfer a force to the legs at the contacting locations. Further, a movement of the legs relative to the tension ring causes tensile forces to be exerted on the tension ring so as to prevent the legs from moving relative to one another.

In accordance with a further aspect of at least one of the inventions disclosed herein, the method involves reinforcing the legs of a stool. In another embodiment, the method involves reinforcing the legs of a table.

BRIEF DESCRIPTION OF THE DRAWINGS

These and other features, aspects and advantages of the inventions disclosed herein are described below with reference to the drawings of a preferred embodiment, which is intended to illustrate and not to limit the inventions. The drawings comprise the following figures.

DETAILED DESCRIPTION OF THE PREFERRED EMBODIMENT

The legged support and the various systems and features associated with it are described in the context of a stool because they have particular utility in this context. However, the legged support and methods described herein, as well as their various systems and features, can be used in other contexts as well, such as, for example, but without limitation, devices and structures that include legs or other similar support members whose movement can benefit from additional reinforcement, such as, for example, seating devices, tables, desks, platforms and the like.

Figure 1A:
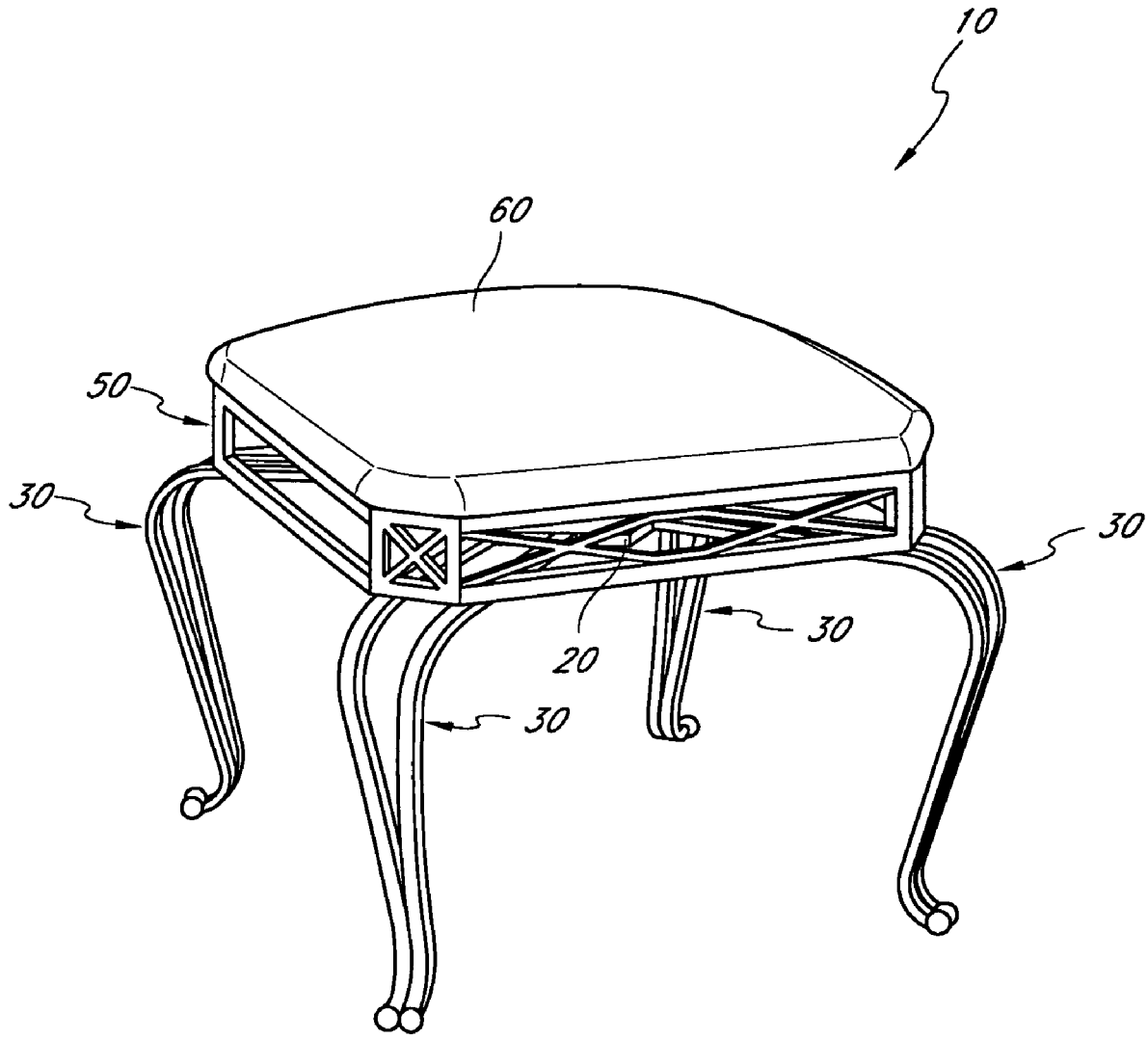
FIG. 1A illustrates a perspective view of a stool according to one embodiment.

With reference to FIG. 1, a stool 10 can include a tension ring 20, a plurality of legs 30, a frame 50 and a cushion 60. As is discussed in greater detail below, the use of the tension ring 20 can enhance the reinforcement of the legs, which, in some embodiments, can prevent the legs from undesirably moving relative to one another (e.g., spreading apart, coming closer together, etc.) without the need for additional supports directly connecting the lower ends of the legs to each other.

As used herein, the terms "stool," "chair," "seating device," and "seating assembly" are used interchangeably. Further, as used herein, the term "ring" refers to a member having a generally circular, oval, elliptical, triangular, square, rectangular, other polygonal or any other shape. The ring can have one or more inner openings. For example, the ring can be shaped like a toroid, hook, frame or the like. The cross sectional shape of the ring's structural members can be circular, oval, elliptical, triangular, square, rectangular, other polygonal or any other shape. In addition, the ring can include cross members or any other features.

Figure 2:
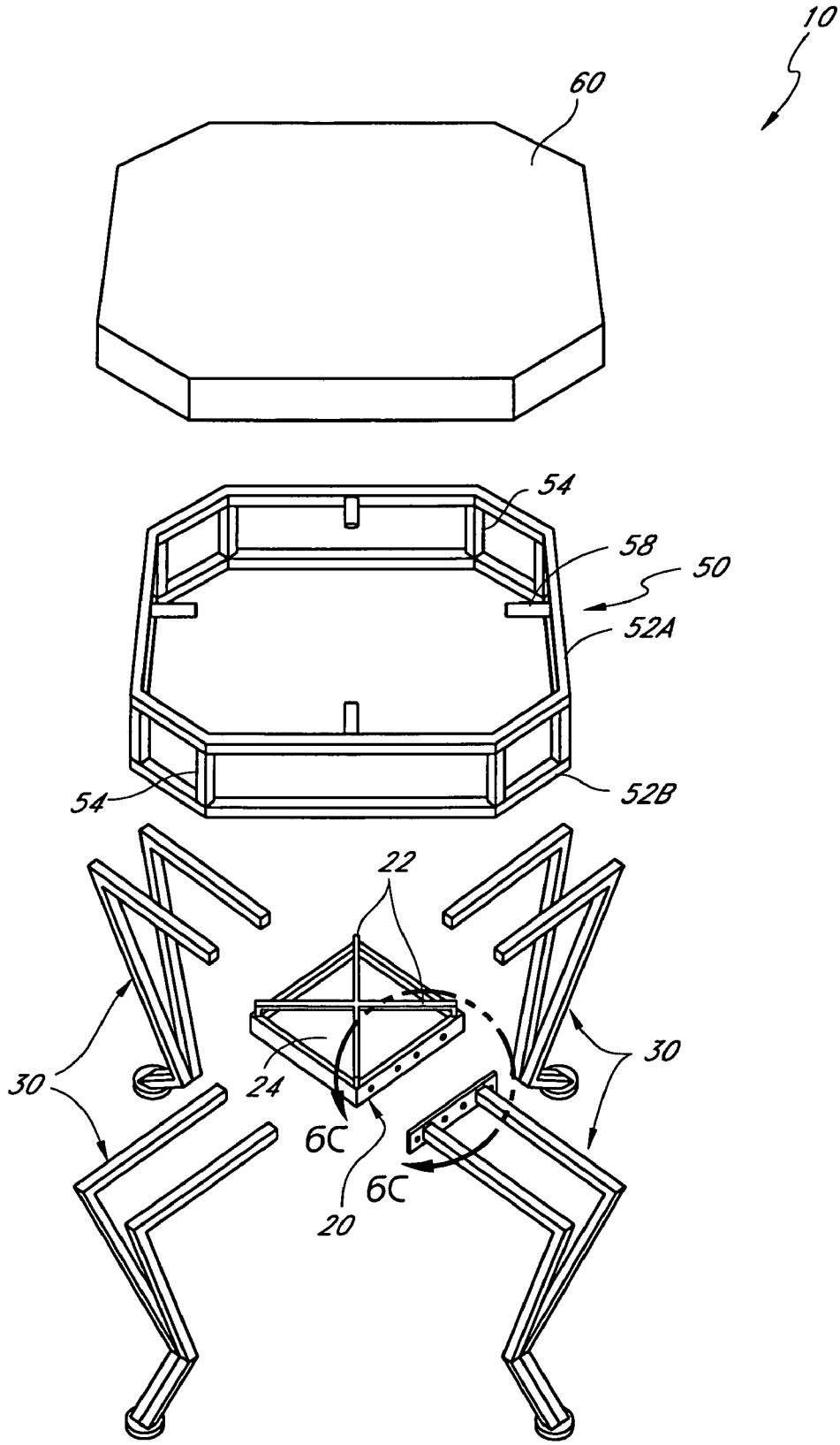
FIG. 2 illustrates an exploded perspective view of a stool with various components detached according to yet another embodiment.

The exploded view in FIG. 2 illustrates the general orientation of the various stool components that can be used. In the depicted arrangement, the stool includes four legs 30, each of which attaches to a different side of a four-sided tension ring 20. It will be appreciated that more or fewer legs 30 can be attached to the tension ring 20.

The tension ring 20 can be constructed of one or more rigid materials having favorable tensile strength properties, such as, for example, steel, iron, aluminum, other metals and metal alloys, plastic, wood or the like. In addition, any other material types can be used, including fiberglass, other composite and the like.

Figure 3:
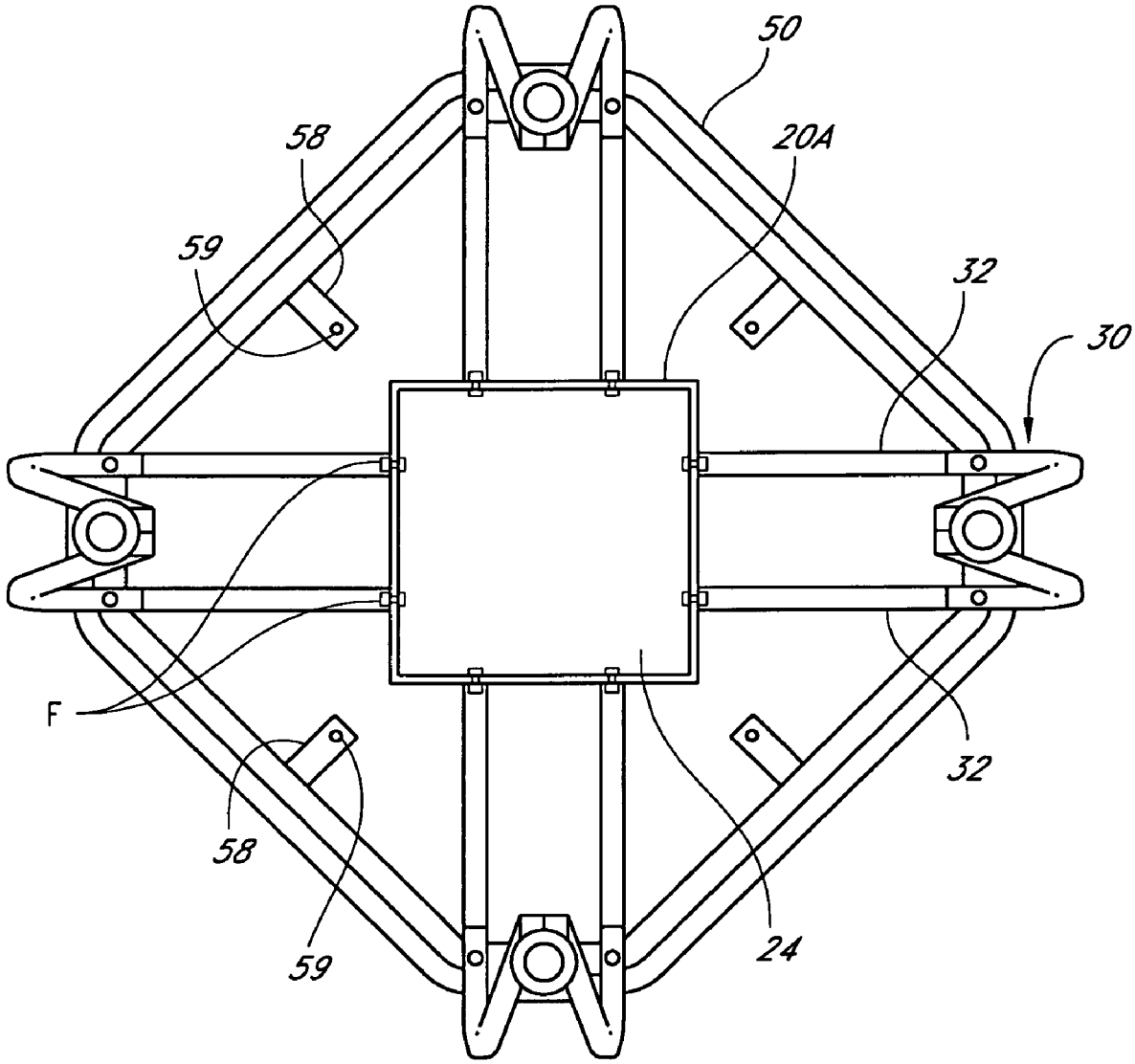
FIG. 3 illustrates a bottom view of the stool of FIG. 1A.

In FIGS. 2 and 3, the tension ring 20 has a substantially square or rectangular shape. Alternatively, however, the tension ring 20 can have a circular, oval, elliptical, polygonal or other shape. For example, FIG. 4 illustrates one embodiment of a circular tension ring 20B, to which are attached four legs 30B.

Figure 4:
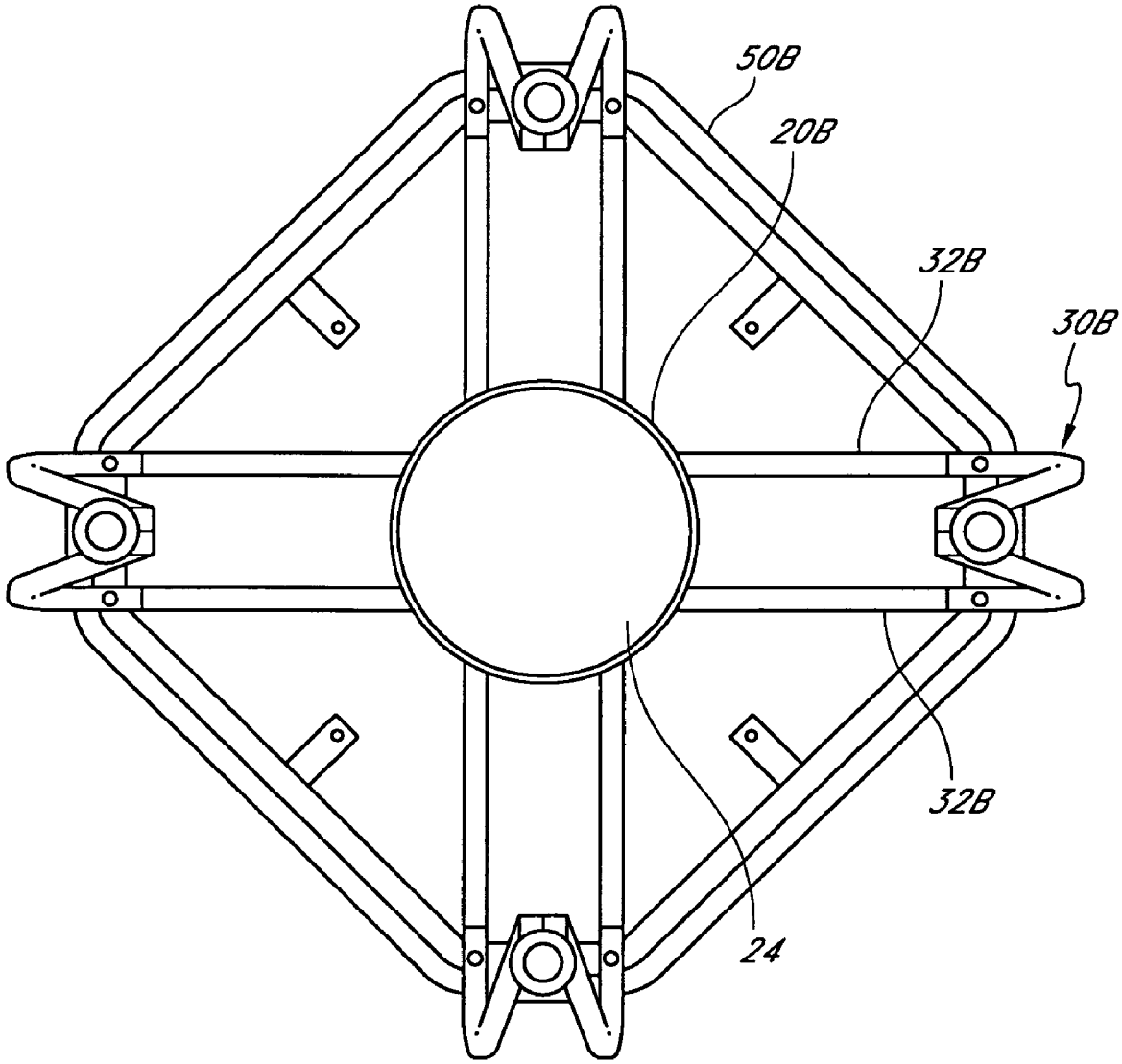
FIG. 4 illustrates a bottom view of a stool according to a different embodiment.

In FIGS. 2 through 4, the depicted tension rings 20 include relatively large inner openings 24. However, in other embodiments, the inner opening 24 can be smaller or larger than illustrated. Furthermore, the tension ring 20 can have additional openings or no openings at all. For instance, the tension ring 20 can be formed from a steel plate or a section of another rigid material so that the tension ring 20 can be a solid or a substantially solid member.

The cross-sectional shape of the tension ring 20 can be rectangular, polygonal, circular, elliptical, oval or the like. Furthermore, the structural components that comprise the tension ring 20 can be solid or hollow. For example, the tension ring 20 can be formed by a steel square or tube formed into a closed shape (e.g., circle, square, etc.). In other embodiments, the tension ring 20 can be manufactured from one or more angles, channels and/or other structural members. The tension ring 20 can be formed into a desired shape using one or more methods, such as, for example, bending, molding, forging, rolling, casting, machining or the like. Alternatively, two or more pieces can be welded, fastened, glued or otherwise connected to one another to create the desired shape of the tension ring 20.

With continued reference to FIG. 2, the tension ring 20 can include one or more cross members 22 (e.g., braces, struts, etc.) which can enhance the ability of the tension ring 20 to resist forces, moments and other stresses to which it can be exposed. The cross members 22 can be welded, bolted, glued or otherwise connected to the desired locations on the tension ring 20. As discussed below with respect to tensile force resistance, it can be desirable for the tension ring 20 to be symmetrical in order to more adequately balance, opposing forces.

Specific leg assemblies, according to some embodiments, are described in greater detail below. However, any type of leg suitable for a stool, chair or other furniture can be used.

With continued reference to FIG. 2, the stool 10 can include a plurality of legs 30 which are connected to the tension ring 20 at or near the upper end of the legs 30. Like with other stool components, the legs 30 can be manufactured from one or more rigid materials, such as, for example, steel, iron, aluminum, fiberglass, plastic, wood or the like. In some embodiments, as illustrated in FIGS. 1A, 2, 5 and 6A, an upper portion of each leg 30 can be substantially horizontal and aligned with the tension ring 20 to which it attaches. However, it will be appreciated that the shape of the legs 30 can vary depending on the furniture type, the desired decorative style and/or other considerations of the specific application.

Figure 6A:
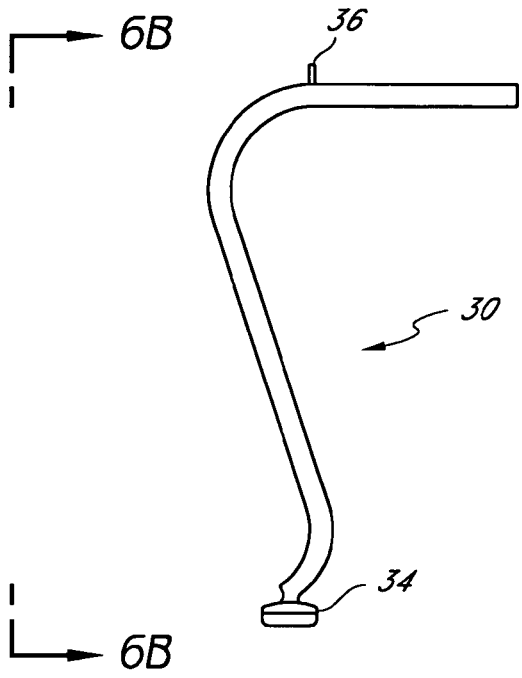
FIG. 6A is a side elevation view of a furniture leg according to one embodiment.

For example, the leg illustrated in FIG. 6A has a curved S-shape between the substantially horizontal upper portion and the foot member 34. In contrast, the legs 30 illustrated in FIG. 2 include sharper transitions which form three distinct regions. In such an arrangement, the profile of the legs can have a Z shape. However, the legs can be differently configured or shaped with more or less intricate designs, as desired or required by a particular application.

Figure 6B:
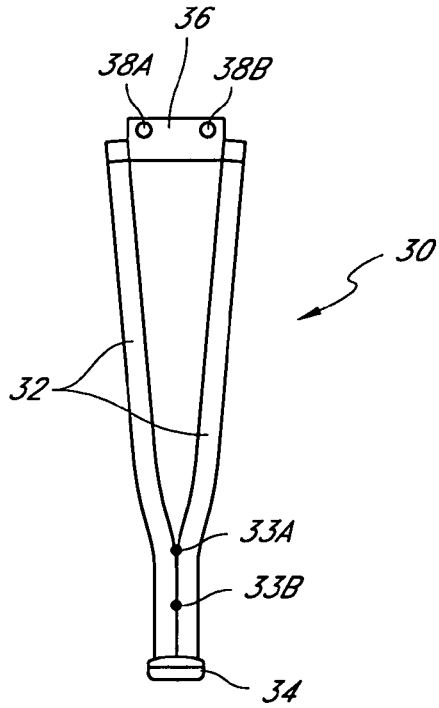
FIG. 6B is a side elevation view of the leg in FIG. 6A.

With reference to FIG. 6B, the leg 30 has a split design, meaning that it comprises two or more separate support members 32. In the illustrated embodiment, the two support members 32 are joined to each other near the lower portion of the leg 30 using welds 33A, 33B. However, additional welds and/or other types of connection methods can be used to attach the separate support members 32 to one another.

For example, the support members 32 can be joined to each other using one or more bolts, screws or other fasteners, pins, adhesives, clips, etc. In other embodiments, the legs 30 can be formed, cast, bent or otherwise manufactured into a desired split design to form a single member. Moreover, the legs 30 can include more or fewer support members 32 than shown and discussed herein. For instance, in a simple arrangement, the leg 30 can comprise only a single structural member.

The split design of the leg 30 can provide multiple connection points between the tension ring 20 and the upper portion of the leg 30. Such configurations can offer a more secure connection between the legs 30 and the tension ring 20 to better resist shear, torsion and other forces exerted on the stool or other furniture. Additional support members 32 can be included to provide more connection points between the leg and the adjacent tension ring 20. Further, the split design can be configured to advantageously offer certain aesthetic and architectural benefits.

The legs 30, which can be hollow or solid, can have any suitable cross-sectional shape, including square, rectangular, polygonal, circular, oval, elliptical and the like. The length of the legs 30 can vary depending on the desired height of the stool or other furniture. Regardless of their materials of construction, size, shape, dimensions and other properties, the legs 30 can be configured to withstand the forces, moments and other stresses to which they can be exposed.

With continued reference to FIGS. 6A and 6B, an upper portion of each leg 30 can include an intermediate tab member 36 to which the frame 50 (FIG. 2) or other member situated above the leg 30 can be attached. In the illustrated embodiment, the intermediate tab member 36 includes two openings 38A, 38B which are configured to receive bolts, screws or other fasteners. Such openings can be used to securely fasten the tab member 36 (and consequently the leg 30) to the frame 50 or other above-situated member.

In FIGS. 6A and 6B, the intermediate tab member 36 can be welded to the adjacent support members 32 of the leg 30. Further, the tab member 36 can be situated in an upright position such that bolts or other fasteners (not shown) inserted through the openings 38A, 38B have a substantially horizontal orientation.

In other embodiments, however, the intermediate tab member 36 can be connected to the leg 30 using one or more other methods. Further, the tab member 36 can comprise more or fewer openings than depicted in FIG. 6B. In yet other arrangements, an upper frame 50 or other member can be configured to connect directly to the leg 30 without the need for a intermediate tab member 36. For example, one or more openings for receiving a bolt or other fastener can be provided directly in the leg 30. Alternatively, the leg 30 can be joined to the adjacent frame 50 or other member using other attachment methods, such as, for example, a pins, clips, adhesives, welds and the like.

Figure 5:
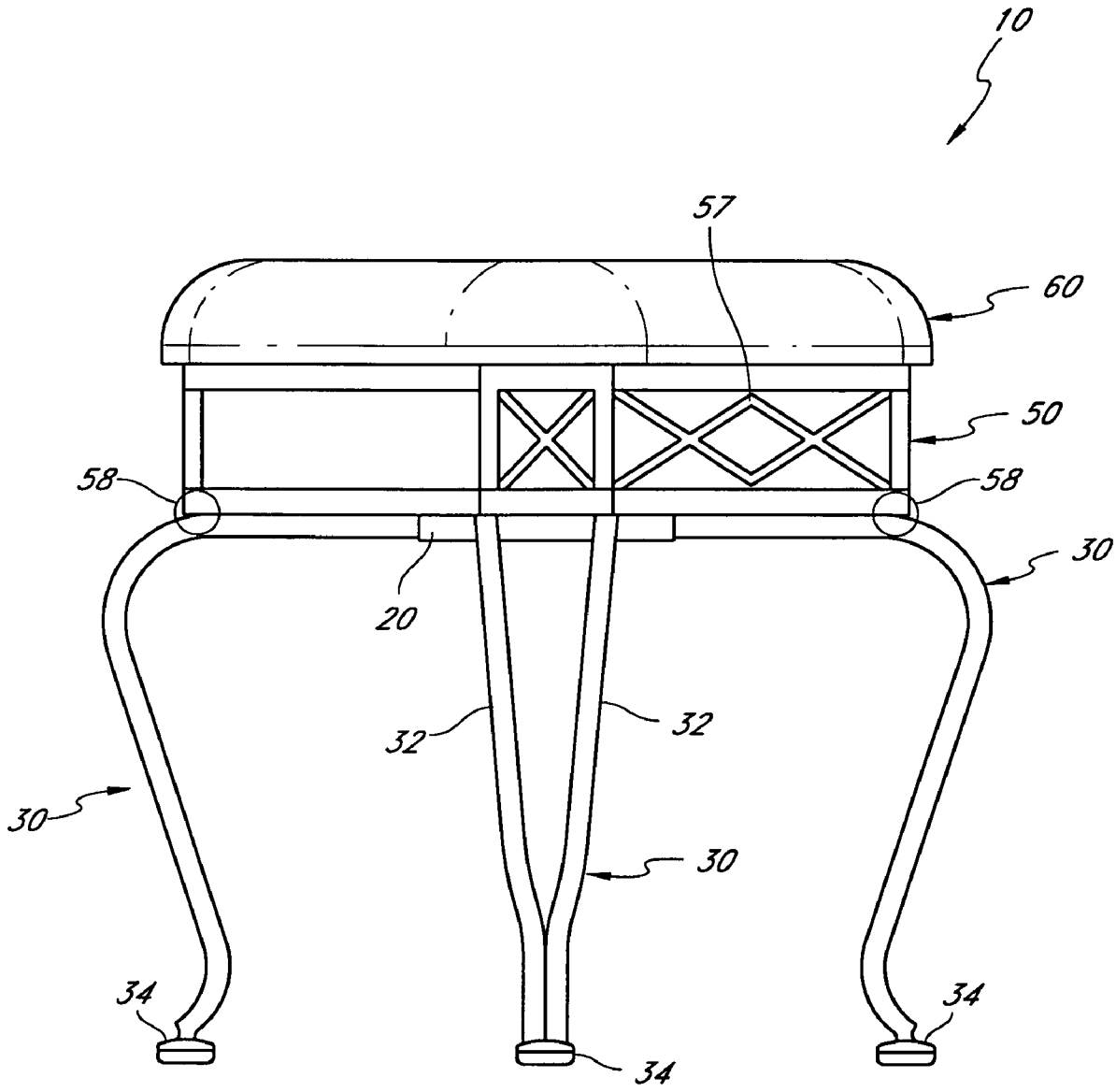
FIG. 5 is a side elevation view of the stool of FIG. 1A.

As illustrated in FIGS. 3 through 5, the upper end of the legs 30 can be attached to an adjacent surface of the tension ring 20. The legs 30 can be connected to the tension ring 20 using one or more welds, bolts, screws, other fasteners, adhesives, clips, pins, hinges or the like. For example, in the embodiment depicted in FIG. 2 and detailed in FIG. 6C, a leg 30 can be connected to the tension ring 20 using one or more fasteners (not shown).

Figure 6C:
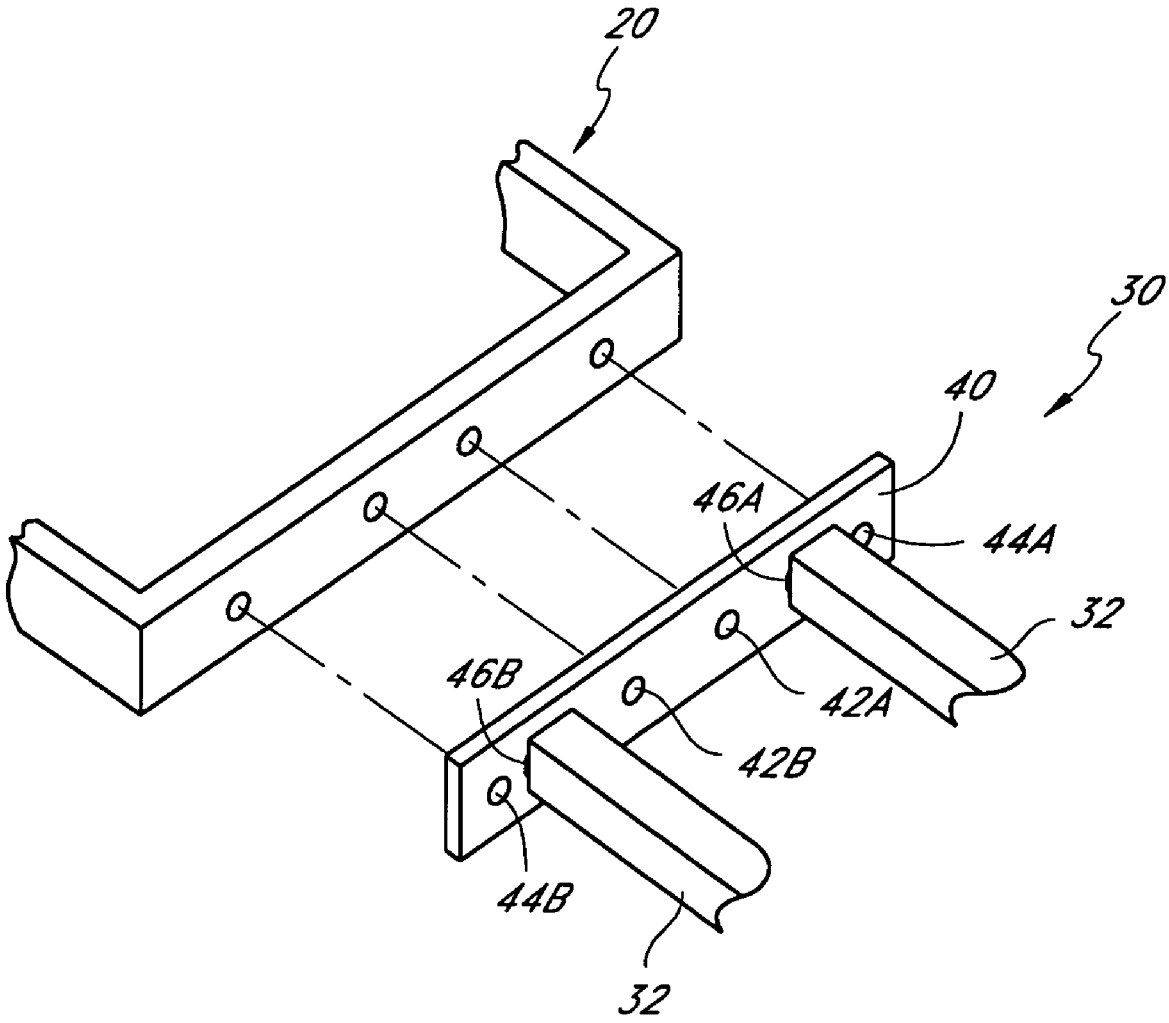
FIG. 6C is a detailed perspective view of the upper end of the leg according to one embodiment.

The leg 30 can comprise an end plate 40 which can be welded or otherwise connected to the support members 32 of the leg 30. In FIG. 6C, the end plate 40 and the adjacent surface of the tension ring 20 include four openings that can be aligned with one another. It will be appreciated that more or fewer openings can be included in the end plate 40 and/or the tension ring 20.

Alternatively, one or more fasteners can be used to connect the legs 30 directly to the tension ring 20 without the need for an end plate 40. For example, as illustrated in FIG. 3, the support members 32 can comprise threaded end openings through which fasteners F can be secured. Thus, fasteners F can be passed from the inside of the tension ring 20, through holes in the tension ring, and secured into the corresponding openings of the support members 32.

With continued reference to FIG. 2, a frame 50 can be positioned on top of the legs 30 and the tension ring 20. When viewed from above, the illustrated frame 50 has an octagonal shape. Moreover, the frame 50 can include an upper frame member 52A and a lower frame member 52B, which can be joined to each other by one or more vertical frame members 54. It will be appreciated that the shape, height, size, dimensions and other characteristics of the frame 50 can be different than illustrated in FIG. 2. For example, in one embodiment, the frame 50 can be circular and substantially flat. In other embodiments, one or more of the frame members 52A, 52B, 54 can have one or more other features, such as, for example, openings, holes, struts, decorative elements or the like). Alternatively, the frame members can be solid (e.g., plate with few or no openings).

The frame 50 can be constructed of one or more rigid materials, such as, for example, steel, iron, aluminum, fiberglass, plastic, wood or the like. As discussed above, the frame 50 can be as simple as a single rigid plate. Alternatively, the frame 50 can have a more intricate design. For example, the frame 50 can comprise a plurality of structural members, such as rods, channels, angles, squares and/or the like, that can be rigidly connected to one another. In addition, as shown in FIG. 5, the frame 50 can include one or more ornamental features 57 that modify the appearance of the stool 10 or other furniture.

With continued reference to FIG. 5, when properly positioned above the legs 30, the frame 50 can contact each leg 30 in at least one contact location 58. As discussed in greater detail below, forces can be transferred from the frame 50 to the legs 30 at these contact locations 58. In addition, as described above with reference to FIGS. 6A and 6B, the legs 30 can include an intermediate tab member 36 that secures the frame 50 to the legs 30, thereby preventing relative movement between these components.

Furthermore, the stool 10 can comprise a cushion 60 or similar member that can be positioned above the frame 50. However, in some embodiments, a single member can take the place of both the frame 50 and the cushion 60. In arrangements where the furniture is not a seating device, the cushion 60 can be replaced with another component. For example, a rigid tabletop, desktop, platform or the like can be secured to the frame 50.

With continued reference to FIGS. 2 and 3, the frame 50 can include one or more frame tabs 58 to which an adjacent cushion 60 or similar member can attach. The frame tabs 58 can include an opening 59 through which a bolt, screw or other fastener can be passed in order to join the frame 50 to the cushion 60. In other embodiments, the frame 50 and cushion 60 can be connected by other methods, such as, for example, by utilizing clips, pins, adhesives, welds and/or the like. Alternatively, it can desirable to allow for relative movement between the frame 50 and the cushion 60. For example, a stool 10 can be configured so that the cushion 60 rotates or swivels relative to the adjacent frame 50.

Figure 1B:
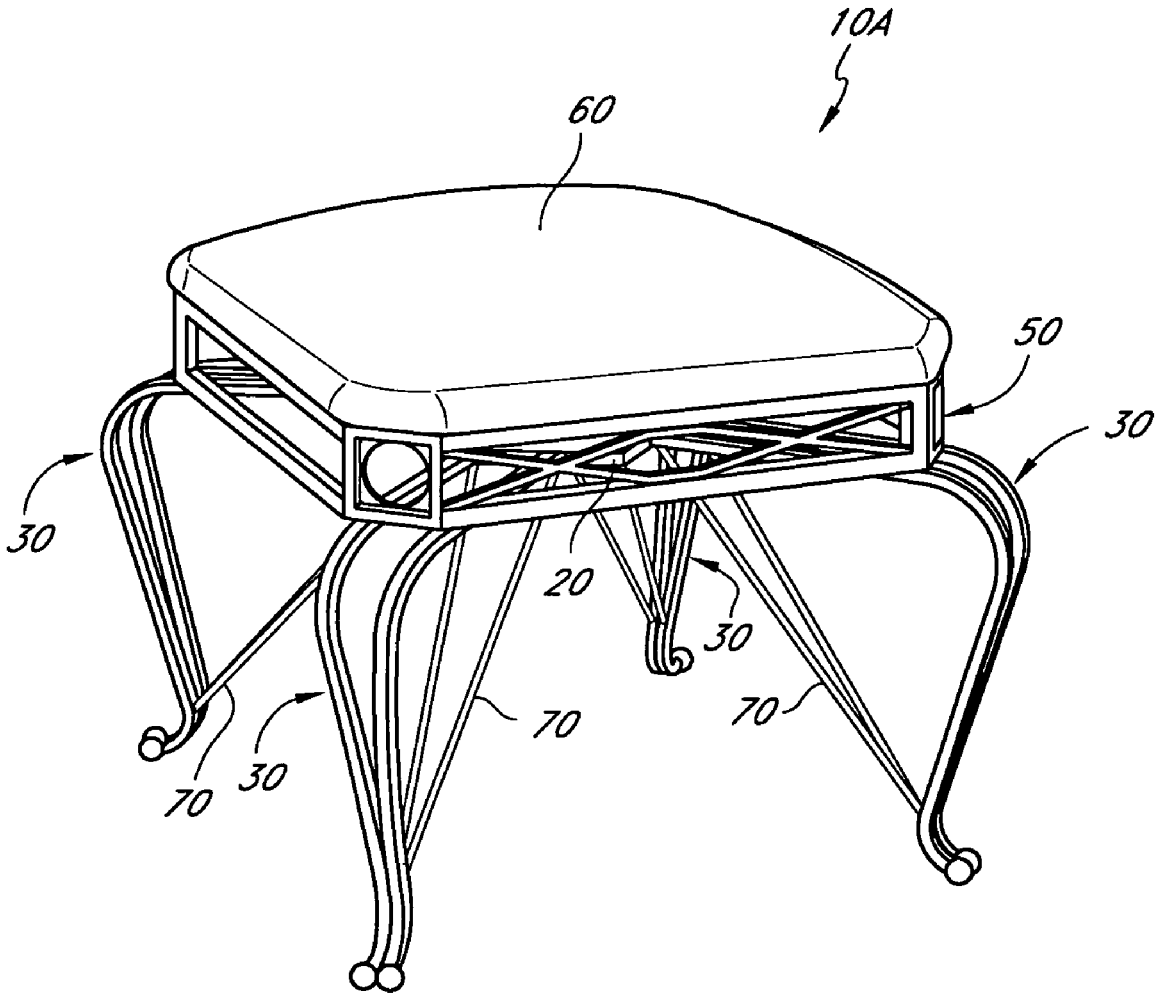
FIG. 1B illustrates a perspective view of a stool according to another embodiment.

The stool 10 or other furniture can include one or more other features. With reference to FIG. 1B, the stool 10A can comprise a plurality of restriction members 70 that connect the tension ring 20 to the bottom of the legs 30. The restriction members 70 can be rigid, semi-rigid and/or flexible. For example, a metal rod, dowel, strut, angle, wire or the like can be used. The restriction members 70 can be sized and otherwise configured to provide further assurance that the legs 30 will not move beyond a desired range. In some embodiments, additional members (not shown) can directly connect the lower ends of the legs 30 to provide further reinforcement against the outward spreading of the legs 30. In other arrangements, the stool 10 can be equipped with a backrest, armrests or the like. Moreover, the legs 30 can include wheel assemblies permitting the stool 10 or other furniture to be easily rolled relative to a bottom surface.

Figure 7:
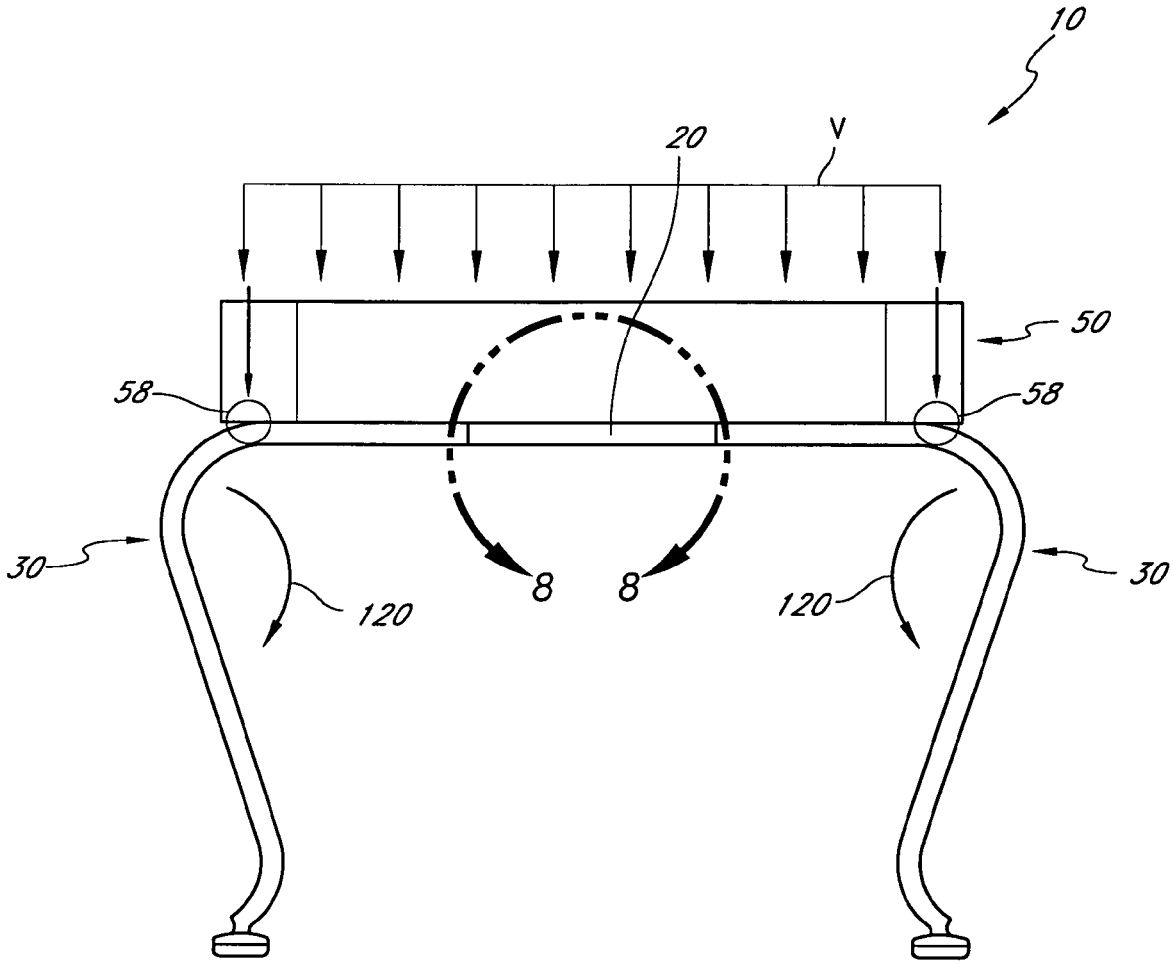
FIG. 7 is a side elevation view of a stool illustrating the various forces and moments acting on the stool according to one embodiment.

FIG. 7 schematically illustrates the forces and moments that can act on the stool 10. This simplified diagram is provided to demonstrate the interaction between the legs 30, tension ring 20 and frame 50 when a distributed vertical force V is applied to the stool 10. As illustrated, the legs 30 can be connected at opposite ends of the tension ring 20. A vertical force V applied to the frame 50 of the stool 10 is transferred to the legs 30 at the contact locations 58, which, in the depicted embodiment, are the sole points of contact between the frame 50 and legs 30. Depending on the location of the legs relative to the contact locations, the length of the legs, the magnitude of the vertical force V and/or other factors, a moment 120 can be created in the legs 30 which causes the legs 30 to tend to spread outwardly in a direction generally away from the tension ring 20. An opposite moment can also be exerted on the legs (e.g., if the legs are urged toward one another).

Figure 8:
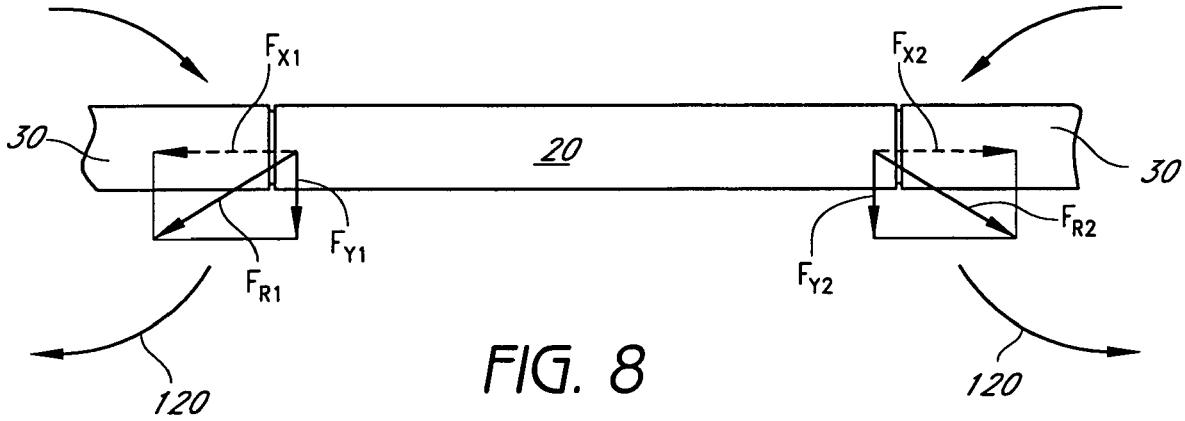
FIG. 8 is a detailed side elevation view of the stool in FIG. 7, illustrating the forces exerted on the tension ring.
Figure 9:
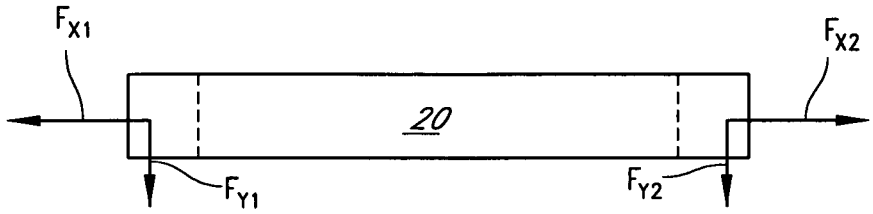
FIG. 9 schematically illustrates the forces exerted on the tension ring of FIG. 8.

FIGS. 8 and 9 illustrate the forces imparted on the tension ring 20 as a result of the moment 120 and/or the movement of the legs 30 relative to the tension ring 20. By way of example, the resultant forces $F_{R1}$, $F_{R2}$ are depicted with arrows. In such embodiments, opposing tensile forces $F_{X1}$, $F_{X2}$ are exerted on the tension ring 20. Such forces, which can be equal or substantially equal in magnitude, act to balance each other. Thus, the tension ring 20 desirably comprises the necessary tensile strength properties to resist the tensile forces $F_{X1}$, $F_{X2}$ exerted on it by the adjacent legs 30. Consequently, the legs 30 can be desirably positioned in a symmetrical pattern around the tension ring 20 so as to counteract the tensile forces created by each leg 30. This can be accomplished by equally spacing out the legs around the tension ring, irrespective of the total number of legs. For example, if a stool 10 comprises four legs 30, the legs can be positioned 90 degrees from each other. Further, if a stool 10 includes only three legs 30, the legs 30 can be positioned 120 degrees apart from each other.

Moreover, the vertical components $F_{Y1}$, $F_{Y2}$ of the respective resultant forces $F_{R1}$, $F_{R2}$ can generate a vertical movement in the tension ring 20. However, such a vertical movement can be minor due, in part, to the connection between the legs 30 and the frame 50 located above it (FIG. 7). The stiffness, slenderness ratio and other structural characteristics of the legs 30 can also affect the extent to which the tension ring 20 moves vertically. The forces illustrated in FIGS. 8 and 9 are provided to indicate the general direction of the force vectors. As such, the relative size and exact direction of the component force vectors can be different than shown.

If the moment is opposite of that illustrated in FIGS. 8 and 9, the legs 30 can tend to move closer together upon the application of a vertical force on the stool 10. Consequently, the forces exerted on the tension ring 20 will also be different than those depicted in FIGS. 8 and 9. For example, the vertical force components on the tension ring 20 are likely to act in the opposite direction, tending to urge, the tension ring 20 upwardly. However, the horizontal force components will still exert tensile stresses on the tension ring 20 in the same direction illustrated in FIGS. 8 and 9. Therefore, the tension ring 20 can be used to balance the tensile forces exerted upon it by the adjacent legs, regardless of whether the legs of the stool 10 are being urged closer together or further apart. As a result, the legs 30 can even be attached to the tension ring using a hinged connection, as long as the hinge is correctly installed to maintain the legs in contact with the tension ring (not rotate) when a load is exerted on the stool. This is possible because the direction of the moment acting on the legs when a vertical force is exerted on the stool will likely remain consistent for a particular design.

The various embodiments of the tension ring described herein can be used to eliminate the need for a ring or other restraining member near the middle or lower portion of the legs. As described above, the ability of the tension ring to balance out the tensile forces generated by the torquing of the legs can reduce or eliminate the movement of the legs relative to each other. This can simplify the design of a stool or other furniture member. Further, the tension ring can be used to improve the aesthetic appearance of a stool or other furniture, especially since the tension ring can be hidden beneath a frame or similar member. Incorporation of the tension ring into a furniture design can also facilitate more efficient manufacturing, packaging, transport, assembly and other related activities.

Although these inventions have been disclosed in the context of a certain preferred embodiment and examples, it will be understood by those skilled in the art that the present inventions extend beyond the specifically disclosed embodiment to other alternative embodiments and/or uses of the inventions and obvious modifications and equivalents thereof. In addition, while several variations of the inventions have been shown and described in detail, other modifications, which are within the scope of this invention, will be readily apparent to those of skill in the art based upon this disclosure. It is also contemplated that various combinations or subcombinations of the specific features and aspects of the embodiments or variations can be made and still fall within the scope of the invention. It should be understood that various features and aspects of the disclosed embodiment can be combined with or substituted for one another in order to form varying modes of the disclosed invention. Thus, it is intended that the scope of the present inventions herein-disclosed should not be limited by the particular disclosed embodiments described above, but should be determined only by a fair reading of the claims that follow.

What is claimed is:

1. A support assembly comprising:

a tension ring;

at least first and second legs, each comprising an upper terminal end, a lower end and a middle portion generally positioned between the upper end and the lower end, said lower end configured to contact a lower support surface; and a frame positioned above the tension ring and the legs, said frame contacting each leg in at least a first location situated between the upper terminal end and the lower end of the leg;

wherein, the tension ring is attached to each leg at a second location proximate to the upper end of each leg, the first location being between the lower end and the second location;

wherein the frame is configured to transfer a force to the legs at the contacting locations;

wherein a movement of the legs relative to the tension ring causes tensile forces to be exerted on the tension ring; and wherein the tension ring is configured to help prevent movement of the first leg relative to the second leg beyond a desired distance without the need for an additional support attached at the lower end or the middle portion of the legs.

2. The support assembly of claim 1 additionally comprising at least one support member having first and second ends, the first end being connected to the tension ring and the second end of the support member being connected to at least one of the lower ends of the legs so as to provide further reinforcement of the legs.

3. The support assembly of claim 1, wherein the legs are attached to the tension ring at locations that are substantially equally spaced from each other.

4. The support assembly of claim 1 additionally comprising third and fourth legs attached to the tension ring.

5. The support assembly of claim 1 additionally comprising a cushion, said cushion positioned above the frame.

6. The support assembly of claim 1, wherein the tension ring has a generally square shape.

7. The support assembly of claim 1, wherein the tension ring has a generally circular shape.

8. The support assembly of claim 1, wherein the legs are attached to the tension ring using at least one fastener.

9. The support assembly of claim 1, wherein the legs are attached to the tension ring using at least one weld.

10. The support assembly of claim 1, wherein the legs have a split design in which at least a portion of the legs have at least two support members.

11. The support assembly of claim 1, wherein the legs are curved into a substantially S shape.

12. The support assembly of claim 1, wherein the frame is secured to at least one leg at a location proximate to the contacting location.

13. The support assembly of claim 1, wherein each of the first and second legs extend upwardly from the respective lower ends toward the respective first locations and extend horizontally inwardly from the first locations to the terminal ends, respectively.

14. The support assembly of claim 1, wherein the lower ends of the legs contact a ground proximate to a location directly below the contacting locations.

15. The support assembly of claim 1, wherein the tensile forces exerted on the tension ring substantially balance each other.

16. A support assembly comprising:

a tension ring;

at least two legs, each leg comprising a first terminal end and a second end, said first terminal end connected to the tension ring and said second end configured to contact a ground; and a frame positioned above the tension ring and the legs, said frame contacting each leg in at least one contacting location, said contacting location situated between the first terminal end and the second end of each leg;

wherein the frame is configured to transfer a force to the legs at the contacting locations; and wherein a movement of the legs relative to the tension ring causes tensile forces to be exerted on the tension ring.

17. The support assembly of claim 16, wherein the tension ring has a generally square shape.

18. The support assembly of claim 16, wherein the tension ring has

19. The support assembly of claim 16, wherein the tension ring eliminates the need for an additional restraining member attached to the legs at a location below the tension ring.

20. The support assembly of claim 16 additionally comprising at least one support member that is configured to attach to at least one leg at a location between the first end and the second end of such leg in order to provide further reinforcement of the support assembly.

21. The support assembly of claim 16, wherein each of the at least two legs extend upwardly from the respective second ends toward the respective contacting locations and extend radially inwardly from the respective contacting locations to the respective terminal ends.

22. A method of reinforcing the legs of a furniture item, said method comprising:

providing a tension ring;

connecting a first terminal end of at least two legs to the tension ring, each of said legs further comprising a second end located opposite said first terminal end and configured to contact a lower surface; and positioning a frame above the tension ring and the legs, said frame contacting each leg in at least one contacting location, said contacting location situated between the first terminal end and the second end of each leg;

wherein the frame is configured to transfer a force to the legs at the contacting locations; and wherein a movement of the legs relative to the tension ring causes tensile forces to be exerted on the tension ring.

23. The method of claim 22, wherein the furniture item comprises a stool.

24. The method of claim 22, wherein connecting a first end of the at least two legs to the tension ring eliminates the need for an additional restraining member attached to the legs at a location below the first end of the legs.

25. The method of claim 22 additionally comprising attaching at least one support member to at least one leg at a location between the first end and the second end of such leg in order to provide further reinforcement of the furniture item.

26. The method of claim 22, wherein the furniture item comprises a table.

* * * * *